US006220466B1

(12) United States Patent
Hayes et al.

(10) Patent No.: US 6,220,466 B1
(45) Date of Patent: Apr. 24, 2001

(54) COMPOSITE CLOSURE, METHOD FOR ASSEMBLING IT AND METHOD FOR CLOSING A CONTAINER WITH IT

(75) Inventors: Thomas H Hayes, Atlanta, GA (US); Cyril Hadyn Saunders, Wantage (GB)

(73) Assignee: CarnaudMetalbox (Holdings) USA Inc., Wilmington, DE (US)

( * ) Notice: Subject to any disclaimer, the term of this patent is extended or adjusted under 35 U.S.C. 154(b) by 0 days.

(21) Appl. No.: 09/155,147

(22) PCT Filed: Mar. 14, 1997

(86) PCT No.: PCT/GB97/00710

§ 371 Date: Jul. 12, 1999

§ 102(e) Date: Jul. 12, 1999

(87) PCT Pub. No.: WO97/35779

PCT Pub. Date: Oct. 2, 1997

(30) Foreign Application Priority Data

Mar. 26, 1996 (GB) ..... 9606378

(51) Int. Cl.[7] ..... B65D 45/30

(52) U.S. Cl. ..... 215/276; 215/347; 215/349; 215/350

(58) Field of Search ..... 215/276, 347, 215/349, 350; 220/319

(56) References Cited

U.S. PATENT DOCUMENTS

| | | | | |
|---|---|---|---|---|
| 4,171,084 | * | 10/1979 | Smith | 215/232 X |
| 4,408,694 | * | 10/1983 | Mueller | 215/276 |
| 4,418,834 | * | 12/1983 | Helms et al. | 220/359 |
| 4,452,842 | * | 6/1984 | Borges et al. | 215/347 X |
| 4,462,502 | | 7/1984 | Luenser et al. . | |
| 4,501,371 | * | 2/1985 | Smalley | 215/232 |
| 4,705,183 | * | 11/1987 | Moloney | 215/276 |
| 4,733,786 | * | 3/1988 | Emslander | 215/230 |
| 4,757,914 | * | 7/1988 | Roth et al. | 220/359 |
| 4,782,968 | | 11/1988 | Hayes . | |
| 4,993,572 | * | 2/1991 | Ochs | 215/260 |
| 5,009,324 | * | 4/1991 | Ochs | 215/276 |
| 5,031,787 | | 7/1991 | Ochs . | |
| 5,062,538 | * | 11/1991 | Ochs | 215/260 |
| 5,372,268 | * | 12/1994 | Han | 215/232 |

FOREIGN PATENT DOCUMENTS

| | | |
|---|---|---|
| 556274 | 11/1974 | (CH) . |
| 0092884 | 11/1983 | (EP) . |
| 0179498 | 4/1986 | (EP) . |
| 0269920 | 6/1988 | (EP) . |
| 0272431 B1 | 6/1988 | (EP) . |
| 693434 | 1/1996 | (EP) . |
| 683521 | 12/1952 | (GB) . |
| 1151443 | 5/1969 | (GB) . |
| 9117093 | 11/1991 | (WO) . |

OTHER PUBLICATIONS

*Cap Liners: A study in technology*, Modern Pkg., vol. 51, No. 6, Jun., 1978.

* cited by examiner

*Primary Examiner*—Stephen K. Cronin
(74) *Attorney, Agent, or Firm*—Wood, Herron & Evans, L.L.P.

(57) ABSTRACT

A composite closure for a container has a moulded plastics band (24) closed at one end by a plastics sure disc (72) which is held captive within a recess formed around the band interior. Also on the band interior is a screw thread (44) by which the closure may attached to a container neck (12). The disc is cut from flat plastics sheet and is initially plane. However, when the closure is fitted to the container a marginal edge region 78 surrounding the container neck is deformed downwardly to generally frustoconical form.

14 Claims, 3 Drawing Sheets

COMPOSITE CLOSURE, METHOD FOR ASSEMBLING IT AND METHOD FOR CLOSING A CONTAINER WITH IT

This invention relates to composite closures for packaging containers, that is to say, closures having a sealing disc arranged as an insert to overlie and seal with the mouth-defining rim of the container, and an open-ended, tubular plastics band in which the disc is fitted and retained. The invention also extends to the insert discs for such closures. The band of such a closure is formed internally with one or more thread or snap-engagement formations which are capable of engaging with a complementary formation or formations on the container to attach the closure and the container together.

For some packaging applications composite closures have various advantages over conventional closures (i.e. those having non-apertured crowns), and they are widely used for food products which either are filled hot or are pasteurised or sterilised in the container.

A form of composite closure is known from European patent specification No. 0272431B1 (Agents ref. 4386), in which the insert disc is cut and stamped-from a multi-layer extruded plastics material so as to have a circular inner portion surrounded by a generally C-shaped outer portion. When the closure has been fitted to a container the outer portion of the insert disc forms a downwardly facing annular channel by which the container rim is received in sealing relation, the inner portion then overlying and closing the container mouth.

A shortcoming of the closure described in EP.0272431 and recited above arises because of the presence of the generally C-shaped outer portion of the insert disc. For enabling the disc to achieve a satisfactory seal security with the container, heat and pressure is used in order to give the disc a required, closely toleranced shade around its margin. The present invention stems from the realisation by the Applicants that substantial cost savings and other benefits may be achieved by use of a planar, at least substantially plastics, sheet, multilayer or otherwise, which is capable of adopting (and adopts) a required non-planar configuration in the fitted closure.

Another composite closure having a plastics or substantially plastics insert disc is shown in U.S. Pat. No. 4,782,968. The disc may be cut from a plane plastics sheet, with the accompanying cost advantages over discs which have a non-planar configuration by use of an appropriate manufacturing method, e.g. by thermoforming. However, in U.S. Pat. No. 4,782,968 the assembly of the closure requires the disc to be secured peripherally to the tubular band of the closure. The securing operation, which is achieved by spin-welding, induction-sealing or mechanical clinching, is an added cost of manufacture. Moreover the attachment of the disc to the band will restrict the ability of the disc to conform itself to the container finish with which it is required to seal, and may limit the applications for which the closure may be used because of the need to avoid excessive stresses at the interconnection made between the two components.

It is also known for conventional plastics closures to provide a disc-like sealing liner of such a size that when the closure is fitted to a container neck it will project outwardly beyond the container rim as an overhanging peripheral margin, and for the closure to have a formation around the underside of its crown and arranged to bear downwardly on the overhanging margin when the closure is fitted, so as by abutment to wrap the margin around the outside radius of the container rim. In this way the security of the seal provided by the liner is enhanced and made less sensitive to top loading of the closure in storage, transit and display. A closure of this kind is featured in European Patent Publication EP 0693434A.

From the foregoing it might accordingly be expected that the combination of an inherently plane insert disc with a closure shell which has an abutment formation arranged to engage an outer peripheral margin of the disc so as to wrap it in close sealing relation around the container finish could provide a composite closure with a desirable combination of relatively low cost and good sealing integrity. However, a wholly or substantially plastics composition for the insert disc and band, together with any elevated temperatures and/or differential pressures to which the closure might be subjected during use and when further allied with an increased ability of the closure to deform because of the weakening effect of the opening in the band above the insert disc, in practice make the achievement of good sealing integrity difficult to achieve reliably.

Failures in seal integrity may have their origin when the disc is being assembled with the band in the initial creation of the closure, and/or they may be caused by the forces which are imposed on the band and the disc during a capping operation to fit the closure subsequently onto a container. Whatever their origin, Applicants have discovered that the sealing failures can be substantially reduced if in the assembled closures the discs are subjected to radially inward compressive forces, and, moreover, doming of the discs resulting from these forces is directed outwardly of the closure, that is, towards the adjacent opening in the band, which is available to accommodate the doming at least partially.

In accordance with the invention from a first aspect there is accordingly provided a composite closure for a container prior to fitting to the same, which comprises a substantially open-ended, tubular plastics band internally formed with one or more thread or snap-engagement formations for engagement with a complementary formation or formations on the container to attach the closure to the container, and a captive insert disc at least substantially of plastics material which is fitted and retained in the band for overlying and sealing with the mouth-defining rim of the container, characterised in that:

a) the disc has its free edge received in an inwardly facing annular recess adjacent an inwardly extending flange formation which forms an opening at one end of the band;

b) the disc is oversized radially in relation to the recess and by engagement of the free edge with the outer periphery of the recess is held in a domed condition which is convex to the closure exterior and projects towards the opening of the band; and c) the band includes abutment means by which, when the closure has been fitted to the container, a marginal region of the disc including the free edge may be deformed downwardly around the container rim.

In accordance with a second aspect the invention provides a method of assembling the band and the disc in the manufacture of the composite closure defined in the previous paragraph, characterised in that the disc is forced into position within the recess, past the thread or snap-engagement formation(s), by engagement of a pushing means with a central region of the disc, the disc being thereby caused to adopt the said convexly domed condition which is subsequently maintained by engagement with the outer periphery of the recess.

From yet a third aspect the invention provides a container closed by a composite closure as defined in the penultimate paragraph and preferably as assembled by the method defined in the preceding paragraph, characterised in that by virtue of its engagement by the abutment means the marginal region is deformed to a downwardly extending, generally frustoconical position.

From a fourth aspect the invention provides a method of forming the closed container defined in the preceding paragraph.

The invention will become more fully apparent from the following description of embodiments thereof, now to be described by way of example and with reference to the accompanying drawings. In the drawings.

Figure 1:
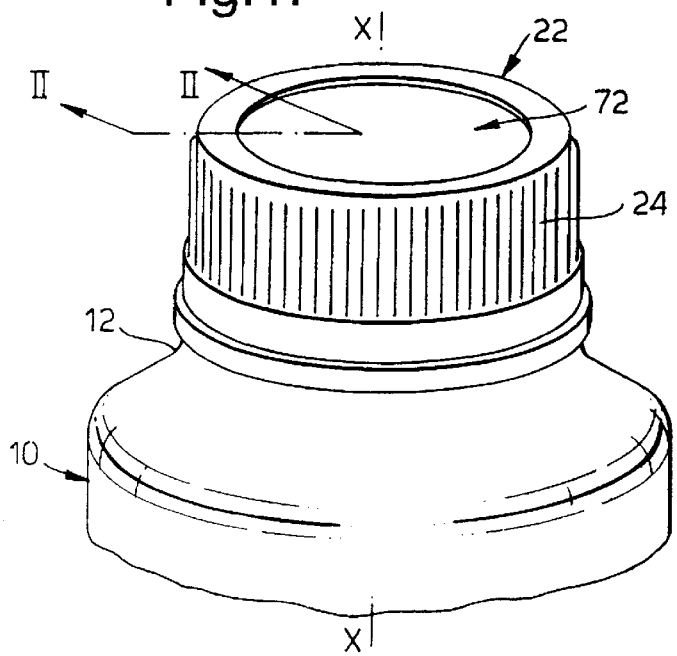
FIG. 1 shows a first closure embodying the invention when fitted to a container.
Figure 2:
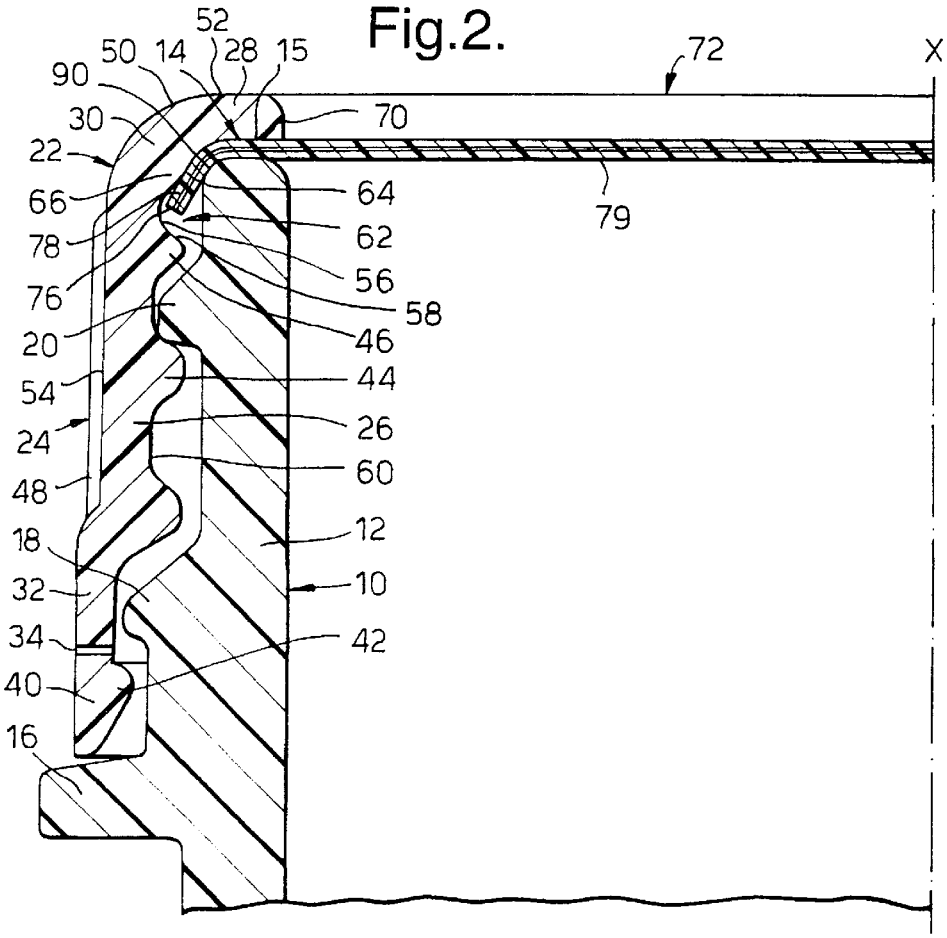
FIG. 2 shows the first closure/container combination as seen on radial section II—II of FIG. 1.

Referring now to FIGS. 1 and 2, a container 10 moulded from PET (polyethylene terephthalate) thermoplastics material has a reduced diameter neck 12 terminating in a rim 14 (FIG. 2) which defines and surrounds the container mouth (not referenced). The rim has a generally plane top face 15, and an outer radius 90.

The neck is generally cylindrical. At some distance from the rim 14 it is exteriorily formed with an annular transfer ring 16 by which the container may be carried for filling etc. operations. Between the transfer ring and the rim it is additionally formed with an annular snap-engagement bead 18, and a continuous turn (CT) screw thread 20 of which a part is visible in FIG. 2.

A composite screw closure 22 is fitted onto the container neck so as to form an hermetic seal with the rim 14. The closure is formed of two components which are separately formed and assembled together after formation. One of the two components is an open-ended tubular plastics band or shell 24 which is injection-moulded from polypropylene. As can be understood from FIG. 2, it has a generally cylindrical central portion 26 and, at respective ends of the central portion, a parallel-faced, radially inwardly extending flange portion 28 having an inner free edge 70, and an enlarged-diameter portion 32. The central and flange portions 26, 28 are joined by an arcuate transition portion 30 forming the top corner of the closure as shown. The enlarged-diameter portion 32 is formed with a line of weakening 34 to form a separable ring 40 at the bottom end of the closure. A bead 42 formed around the interior of this ring is capable of engaging beneath the snap-engagement bead 18 of the container so as to sever the ring from the closure in known tamper-evident manner when the closure is removed.

The central portion 26 of the plastics band is internally formed with a continuous turn screw-thread 44 capable of making screw threaded engagement with the screw thread 20 of the container as shown. Between the screw thread and the flange portion 28, and at a spacing from each, it is additionally formed with an annular retaining bead 46 which extends continuously around the closure with its crest lying approximately on the same radius as the crests of the screw thread 44. The exterior of the central portion is formed with projecting ribs 48 to assist gripping by the user.

Attention is now drawn to the transition portion 30 of the band 24, and the nature of its respective attachments to the central and flange portions 26, 28. The exterior surface 50 of the transition portion is part-circular in cross-section, extending over a subtended angle of 90°. It merges at its ends into the exterior surface 52 of the flange portion and the base exterior surface 54 of the central portion, from which the ribs 48 project. The exterior surface 52 of the flange portion is planar, whereas the surface 54 of the central portion is cylindrical.

The interior surface (not referenced) of the transition portion 30 is specially shaped for a purpose to become apparent. At its bottom end it merges with the upper flank 58 of the annular bead 46, in axial alignment with the base interior surface 60 of the central portion 26. From its junction with the bead 46 it follows a part-circular locus over a subtended angle of about 90°, as the outer periphery 56 of an inwardly facing recess 62 which extends around the band 24 with the flank 58 forming its lower side face.

Above the outer periphery 56 of the recess 62 the interior surface of the transition portion 30 is frustoconical, and tapers upwardly and inwardly at an angle of approximately 45° to the closure axis XX. This frustoconical portion 64 forms the upper side face of the recess, and merges at its top end with the under surface (unreferenced) of the flange portion 28. Together with the periphery 56 it forms a shallow bulge 66 which projects downwardly and inwardly in a convex manner within the recess 62 and towards the closure interior.

It will therefore be seen that the base thickness of the band 24 is generally uniform over the central, transition and flange portions 26, 30 and 28, the thread 44, bead 46 and bulge 66 being each formed by a local thickening of the band wall.

The second component of the composite closure 20 is a sealing and closure disc 72 which forms an insert in the band 24 . The disc is circular, and is severed from plastics sheet created by co-extrusion of multiple layers of plastics material through a horizontal and rectilinear die orifice (not shown). The disc is originally planar, but as described below is deformed to the upwardly domed shape shown in FIG. 2 when the disc is inserted into the band and the closure is subsequently fitted onto the container 10. The disc then closes the circular opening (not referenced) defined by the free edge 70 of the band.

Figure 4:
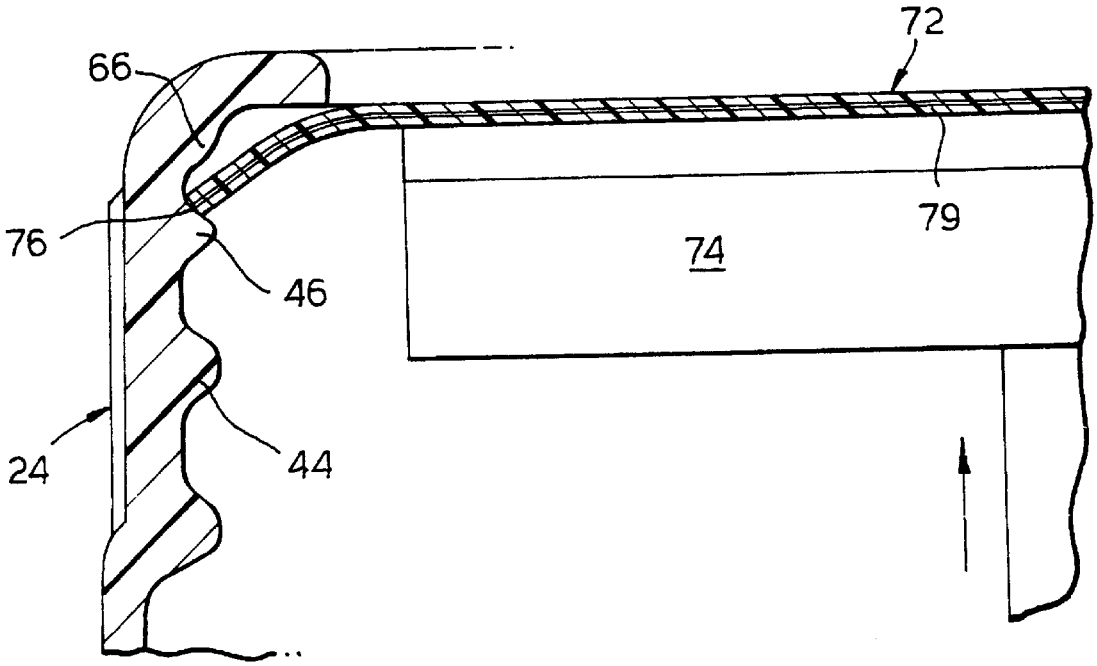
FIG. 4 illustrates the assembly of the closure disc with the closure band in the formation of the first closure.

The diameter of the disc 72 is greater than the greatest diameter of the annular recess 62, which occurs at its outer periphery 56. As is illustrated in FIG. 4, the insertion of the disc in the band is achieved by a cushioned pusher member 74 which engages the disc over a central part of its area, leaving a peripheral margin of the disc free. With the band suitably restrained against movement the disc is forced upwardly past the screw thread 44 and retaining bead 46 of the band until its free edge 76 comes to rest in the recess 62.

In moving past the thread 44 and bead 46 the closure disc is forced to adopt an upwardly domed condition. The doming will occur primarily in the overhanging margin of the disc outside the pusher member 74, which will accordingly be deformed downwardly in relation to the general plane of the disc as shown.

It may be preferred to prevent any doming of the disc above the pusher member, and this may be achieved by means of a clamping member (not shown) which engages the disc above the pusher member and is resiliently restrained by suitable means. In general, however, doming of the disc above the pusher member is considered to be desirable and is therefore encouraged; in this respect it should be remembered that the opening in the band 24 is available to accommodate any convexity of the disc within the free edge 70 of the band.

Because it is oversized in relation to the recess 62, the disc 72 is not free to flatten fully when the closure has been assembled and the pusher member 74 has been withdrawn. The disc is therefore held in its domed condition by generally radially inward compressive forces imposed on it by the band 24. Residual doming in this sense is beneficial, because it ensures correct deformation of the disc when the closure is later fitted to a container as is now described. The closure disc after assembly to the band 24 is held securely captive within the recess 62 by the bulge 66 and bead 46 on each side and by the interference of its free edge 76 with the outer periphery 56 of the recess. The location and orientation of the disc within the band are therefore held within close tolerance limits, with little or no risk of cocking or random deformation which could impair the seal security of the closure after capping. In this condition the closure is despatched to the packer.

Figure 5:
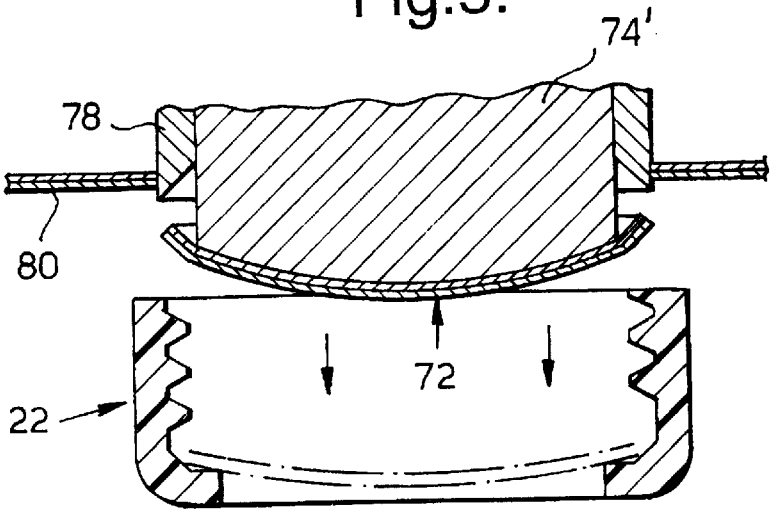
FIG. 5 illustrates how the closure disc may be cut from parent sheet and assembled within the closure band by a heated punch assembly.
Figure 6:
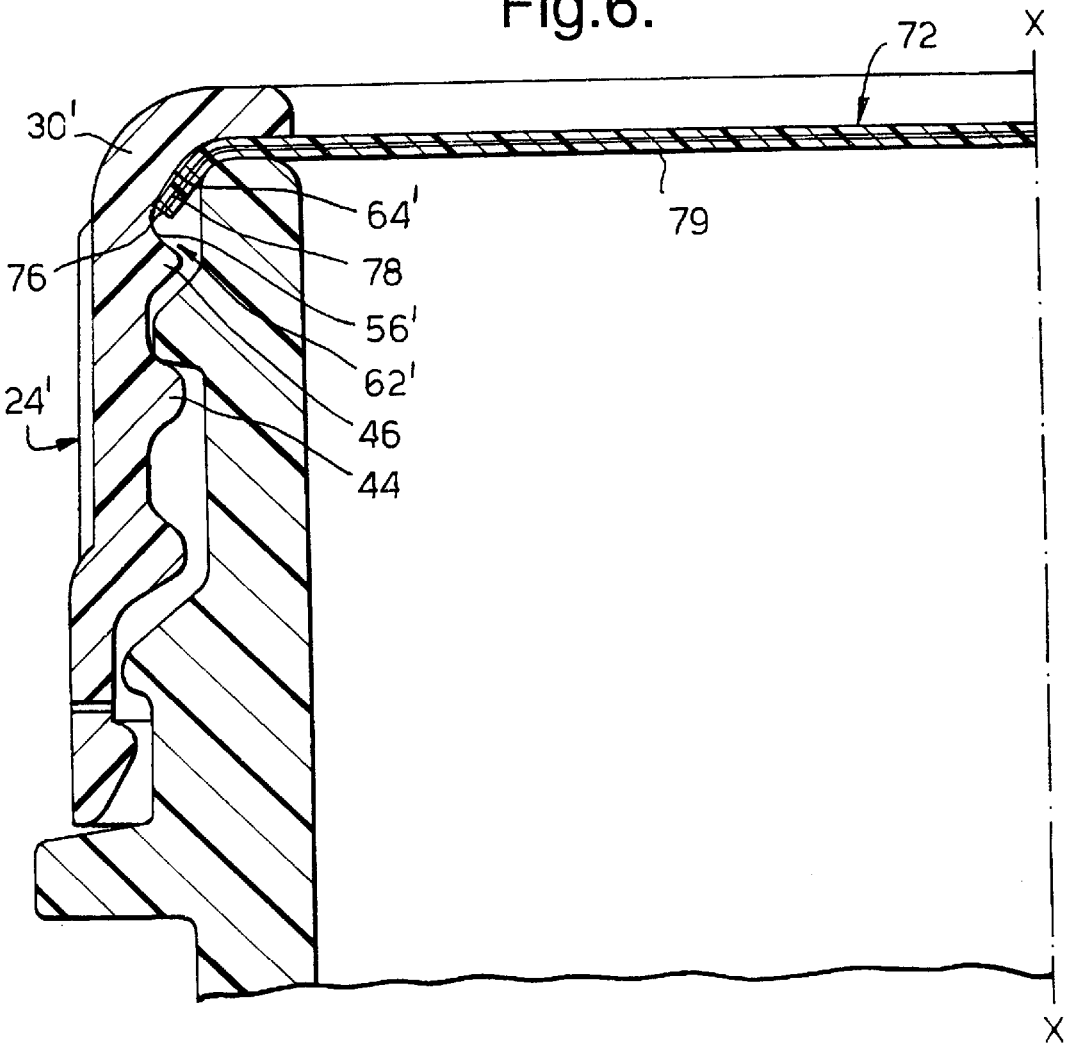
FIG. 6 is a view similar to FIG. 2 and showing a second closure/container combination in accordance with the invention, as seen on a radial section.

FIG. 5 shows the use of a punch assembly incorporating a heated punch 74' to form a disc 72 which has a domed configuration even prior to insertion into the band 24. With the assistance of a cutting ring 78 the punch is also used to sever the disc from parent sheet 80.

The closure may be applied to a product-filled container 10 by conventional capping equipment, possibly (but not necessarily) at a time when the product is hot, and/or steam exists in the headspace above it. As the container neck 12 moves, in relative terms, up and within the closure, its rim 14 engages the underside of the closure disc and forces the disc upwardly against the flange portion 28.

A marginal region 82 of the closure disc including its free edge 76 lies radially outside the container rim 14. Before the disc engages the flange portion 28, this region, which is already subject to some downward deformation from the closure assembly operation as described above, comes into engagement with the bulge 66 of the band 22 and is subsequently deformed by the bulge further downwardly to the substantially inclined position shown in FIG. 2. During this further downward movement of the marginal region the portion of the disc overlying the container mouth may be subject to doming movement in the upward direction.

The bulge can therefore be regarded as an abutment means for the disc. Because of the substantial deformation of the disc which it creates, the marginal region 82 of the disc moves inwardly and downwardly with a substantially frustoconical configuration, and the disc free edge 76 may, as shown, lose contact with the band 22. However, the free edge still lies radially well outside the crest of the bead 46. Applicants prefer that at the end of the capping operation the included cone angle of the generally frustoconical marginal region 82 should be within the range 120° to 60°, preferably about 90°.

Figure 3:
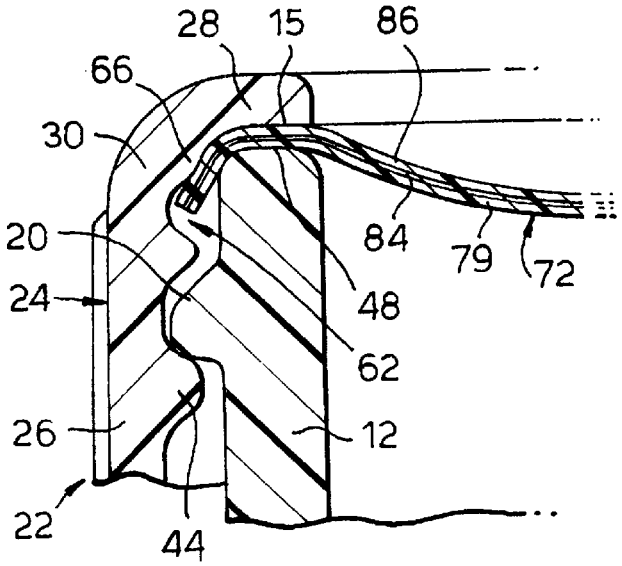
FIG. 3 is a scrap view of the first closure/container combination in a slightly modified form but illustrating the behaviour of the combination in response to negative pressures within the container.

As previously mentioned, the closure disc 72 has a multilayer plastics structure. It may have two or more layers, an intermediate one of which, e.g. of EVOH, may be provided for gas and/or moisture barrier enhancement. Only one of its layers is specifically shown in FIG. 2. It is the innermost layer 79 of the disc, and is formed of a relatively soft, shape-conforming polymer resin such as a soft grade of polypropylene. FIG. 3 additionally shows the disc to have a thin central barrier layer 84 and a thick upper layer 86 which imparts substantial mechanical strength to the disc. Suitable materials for the layers 84, 86 are well known to the skilled man.

When, during capping, upward relative movement of the marginal region 82 of the closure disc 72 is being impeded by the bulge 66, the marginal region becomes wrapped downwardly around the outer radius 80 of the container rim 14 so that the soft underlayer 79 of the disc in that locality is brought into intimate contact with the container finish and forms a seal with the container.

Because of the axially directed component of its orientation, the seal made by the disc at the radius 80 is less susceptible to top-loading variations than would be a seal formed solely with the generally plane top surface of the container rim 14. Moreover, during capping the transition and flange portions 30, 28 of the closure band 24 are subject to elastic deformation in the outward direction, with the result that a substantial resilient pressure generally normal to the marginal region 82 of the disc 72 is maintained by the band after capping has been completed. Accordingly, and by virtue also of the soft and conforming nature of the layer 79, the seal formed between the disc and the container is hermetic and secure up to the first opening by the user, despite imperfections which may exist in the container finish. Also, and as is illustrated in FIG. 3, the downward inclination of the marginal region 82 enables the closure disc better to resist inward (i.e. downward) doming caused by high levels of partial vacuum within the container which may be generated by products which are hot-filled and/or steam-flow-closed.

Removal of the closure 22 by the user is achieved in the normal way by unscrewing the band in the appropriate direction. If, as previously mentioned, the free edge 76 of the disc has lost contact with the band in its inward and downward movement when the closure was applied, the band is initially able to turn and rise through a small initial movement before the disc is disturbed. With further band movement the free edge of the disc is engaged by the upper flank of the retaining bead 46, the seal made between the disc and the container is broken, and the disc rotates and rises with the band for removal. Because of this two-stage process the maximum torque which the user must exert to remove the closure is substantially reduced. This is of particular value if a high partial vacuum exists in the container headspace and/or substantial adhesion caused by product residues is present at the disc/container interface.

On the other hand, if the degree of doming resulting from the closure assembly operation is sufficient, the free edge 76 of the disc 72 may remain in compressive engagement in the band recess 62 throughout the capping operation. Such an arrangement may be preferred for applications of the invention where high removal torques are unlikely to be encountered.

Whether or not the free edge of the disc maintains contact with the band during capping, the downward inclination of its marginal region 82 resulting from the deformation which occurs during assembly and capping as described above enhances the ability of the disc to withstand closure removal forces without inversion, so reducing any danger that the band can separate from the disc and leave it behind on the container. A further contribution to satisfactory disc removal is provided by any cold setting of the plastics material of the disc to its deformed state which occurs in the fitted closure in the time which elapses prior to removal. The cold set prevents any substantial relaxation of the disc towards its original plane condition during the limited time when the band is being unscrewed.

FIG. 4 shows a second embodiment of the invention to be identical to the embodiment described above, except for the transition portion of the plastics band. The modified transition portion and the band of which it forms part are accordingly denoted by the references 30' and 24'.

Instead of combining to form a bulge 66 as in FIG. 2, the frustoconical abutment surface 64' of the transition portion 30' of this second embodiment merges smoothly with the generally part-circular outer periphery 56' of the internal recess 62'. Therefore, whilst the transition portion therefore again provides an abutment means by which the marginal portion 82 is abutted and deformed, the degree of deformation which results is somewhat less than the deformation caused by the bulge in the first embodiment, and the closure may therefore be more suited for use with products for which only a liquid seal is required.

The invention may be applied to closure/container combinations having multi-start threads rather than the continuous turn screw threads of the embodiments shown. In one modification of the described arrangements the screw threads 20, 44 of the container and closure are multi-start, and the bottom faces of the recesses 62, 62' are discontinuous and formed by the top ends of the segments of the respective closure screw thread 44. The beads 46 are accordingly omitted.

Whilst the closures of the described embodiments have closure discs made entirely of plastics material, it is contemplated that in some applications of the invention a thin metal layer or layers may be included. In one such arrangement the outer surface of the closure disc is formed for cosmetic purposes by a thin, vacuum-deposited, metal covering.

The invention is not limited in application to screw closures as particularly described, but also has application to snap-on closures. In addition, whilst it is preferred and advantageous for the whole of the closure disc to be initially plane for assembly to the closure band as described above, within the scope of the invention are closure arrangements and methods of forming them in which the closure disc is initially non-planar. For example, the part of the disc destined to overlie the container mouth may be formed with ribs for strengthening purposes, and/or it may be recessed at a shallow frustoconical step capable of locating the disc centrally in relation to the container by engaging inside the container rim.

What is claimed is:

1. A composite closure for a container having a mouth-defining rim prior to fitting to the same, which comprises a substantially open-ended, tubular plastics band (24, 24') internally formed with one or more thread formations (44) for engagement with a complementary formation or formations (20) on the container to attach the closure to the container, and a captive insert disc (72) having a free edge at least substantially of plastics material which is fitted and retained in the band for overlying and sealing with the mouth-defining rim (14) of the container, characterised in that:

a) the disc (72) has its free edge (76) received in an inwardly facing annular recess (62, 62') having an outer periphery adjacent an inwardly extending flange formation (28) which forms an opening (70) at one end of the band;

b) the disc (72) is oversized radially in relation to the recess (62, 62') and by engagement of the free edge (76) with the outer periphery of the recess is held in a domed condition which is convex to the closure exterior and projects towards the opening (70) of the band (66).

2. A closure according to claim 1, characterised in that by virtue of the doming thereof the disc projects into the opening in the flange formation.

3. A closure according to claim 1 or claim 2, wherein the closure disc is inherently plane but held in its domed condition by engagement with the outer periphery of the recess.

4. A closure according to claim 1, characterised in that the insert disc has a multilayer structure having its layer which is innermost in the closure formed of a soft plastics material.

5. A closure according to claim 1, characterised in that the recess is formed between the flange formation and an inwardly extending retention bead formed around the band adjacent the thread or snap-engagement formation(s) thereof.

6. A closure according to claim 1, characterised in that the abutment means is convex to the interior of the closure.

7. A closure according to claim 1, characterised in that the abutment means (66) is frustoconical.

8. A method of assembling the band and the disc in the manufacture of the composite closure claimed in claim 1, characterised in that the disc is forced into position within the recess, past the thread or snap-engagement formation(s), by engagement of a pushing means with a central region of the disc, the disc being thereby caused to adopt the said convexly domed condition which is subsequently maintained by engagement with the outer periphery of the recess.

9. A composite closure in accordance with claim 1 when fitted onto a said container, characterised in that by virtue of its engagement by the abutment means (66), the marginal region (82) of the disc (72) is deformed to a downwardly extending, generally frustoconical position.

10. A combination according to claim 9, wherein the marginal region of the disc is inclined downwardly, by an angle within the range 30° to 60°.

11. A combination according to claim 10, wherein the marginal region of the disc is inclined downwardly by an angle of about 45°.

12. A combination according to claim 9, characterised in that the free edge (76) of the disc (72) has been separated from the base of the recess (62, 62') by the deformation caused by the abutment means (66).

13. A combination according to claim 9, characterised in that the free edge (76) of the disc (72) remains in engagement with the base of the recess (62, 62').

14. A combination according to claim 13, characterised in that the closure is a screw closure.

* * * * *

UNITED STATES PATENT AND TRADEMARK OFFICE

CERTIFICATE OF CORRECTION

PATENT NO. : 6,220,466 B1
DATED : April 24, 2001
INVENTOR(S) : Thomas Hayes et al.

It is certified that error appears in the above-identified patent and that said Letters Patent is hereby corrected as shown below:

Title page,
Item [57], ABSTRACT,
Please delete the entire ABSTRACT and replace it with the following:
-- A composite closure for a container has a moulded plastics band (24) closed at one end by a plastics closure disc (72) which is held captive within a recess (62) formed around the band interior. Also on the band interior is a screw thread (44) by which the closure may be attached to a container neck (12). The disc is cut from a flat plastics sheet and is initially plane. It is oversized in relation to the recess of the band, so that in the assembled closure it is held in an outwardly domed condition by inward compressive stresses exerted by the band. This domed configuration assists with the capping operation, when a marginal edge region (82) of the disc which lies radially outside the container neck is deformed downwardly to generally frustoconical form. --

Column 1,
Line 36, please delete "shade" and replace it with -- shape --.

Signed and Sealed this

Eighteenth Day of June, 2002

*Attest:*

*Attesting Officer*

JAMES E. ROGAN
*Director of the United States Patent and Trademark Office*